United States Patent [19]

Kasper

[11] Patent Number: 4,842,228

[45] Date of Patent: Jun. 27, 1989

[54] SUPPORT FOR A TRASH BAG AND METHOD OF USING SUCH SUPPORT

[75] Inventor: Brenda M. Kasper, Hollywood, Calif.

[73] Assignee: Stan Phillips Incorporated, Hollywood, Calif.

[21] Appl. No.: 95,996

[22] Filed: Sep. 14, 1987

[51] Int. Cl.[4] ..... B65B 1/04

[52] U.S. Cl. ..... 248/97; 220/1 T; 141/316

[58] Field of Search ..... 248/95, 97, 99, 150, 248/152, 154; 141/316, 390, 391; 53/390; 220/1 T, 401, 404

[56] References Cited

U.S. PATENT DOCUMENTS

| | | | |
|---|---|---|---|
| 1,879,410 | 9/1932 | Morris | 141/390 X |
| 3,915,329 | 10/1975 | Zaks | 141/316 X |
| 3,983,914 | 10/1976 | Benson | 141/390 |
| 3,997,072 | 12/1976 | Guth | 220/1 T |
| 4,014,157 | 3/1977 | Pearce | 248/154 X |
| 4,105,412 | 8/1978 | Petzinger | 220/1 T X |
| 4,222,580 | 9/1980 | Krokonko | 248/98 X |
| 4,254,602 | 3/1981 | Boynton | 220/1 T X |
| 4,440,321 | 4/1984 | Campbell | 220/1 T X |
| 4,457,483 | 7/1984 | Gagne | 248/97 |
| 4,643,380 | 2/1987 | Copland | 248/150 X |

*Primary Examiner*—J. Franklin Foss
*Assistant Examiner*—Robert A. Olson
*Attorney, Agent, or Firm*—Whann & Connors

[57] ABSTRACT

Disclosed is a device for holding a plastic trash bag in an open, upright position including a tubular liner member that is placed inside the trash bag to open the bag and provide support for holding the bag in an upright position. This liner member preferably is of a hollow, truncated, conical configuration with the bottom end being adjacent the closed end of the trash bag and being slightly greater in diameter than the opposed top end of the liner. A removable cover is placed over the bottom end of the liner member after the liner member has been inserted into the trash bag. This cover includees a pair of opposed, hingedly mounted handles that move into a locking position to hold the assembly of the liner and cover together with the bag sandwiched therebetween. The device may be equipped with a lid that covers the open end.

3 Claims, 2 Drawing Sheets

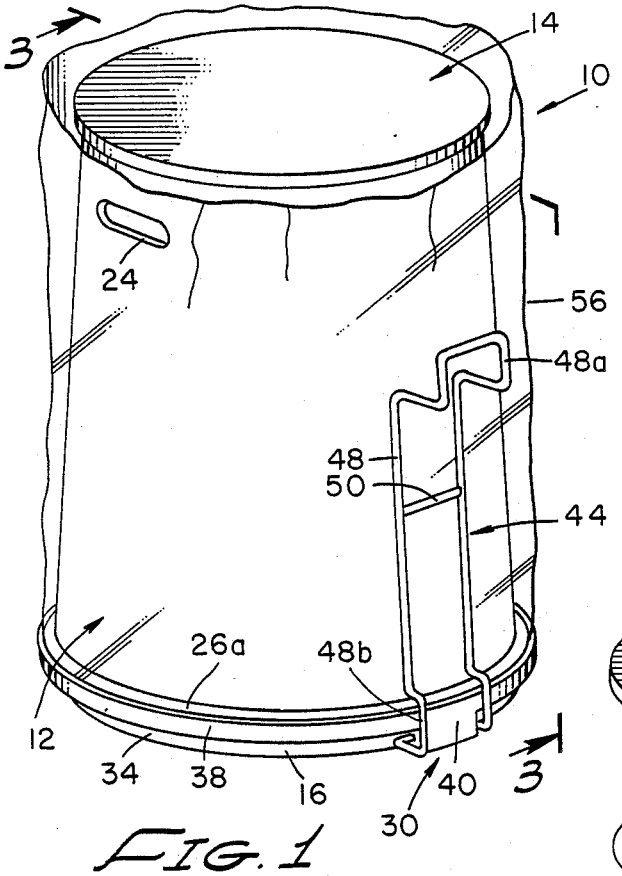
FIG. 1
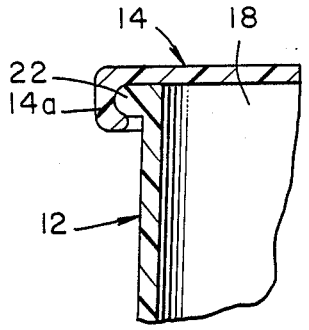
FIG. 4
FIG. 2
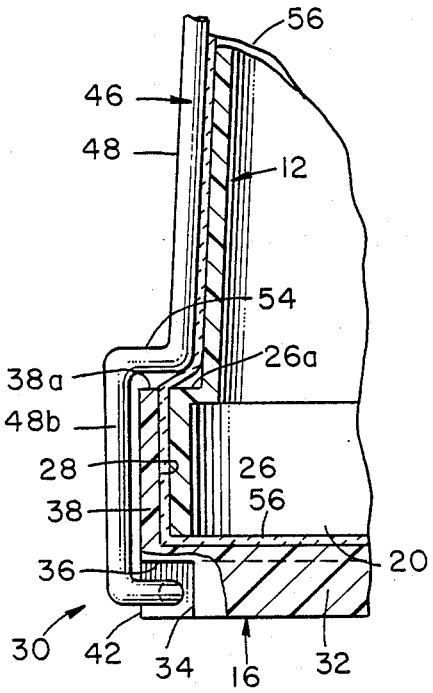
FIG. 5
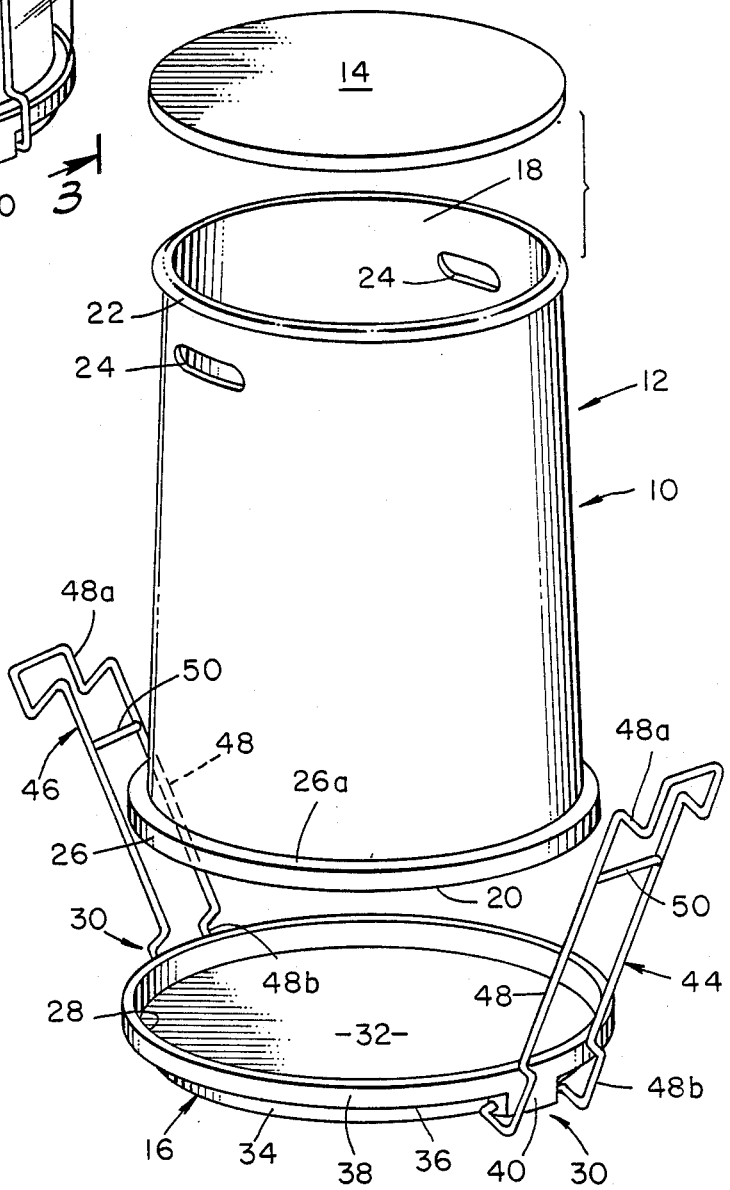

SUPPORT FOR A TRASH BAG AND METHOD OF USING SUCH SUPPORT

BACKGROUND OF THE INVENTION

1. Field of the Invention

This invention relates to a device for holding a plastic trash bag in an open condition while being filled, and particularly is related to such a device employing a hollow tubular member which serves as a liner and support for the trash bag and is inserted into the bag to hold the bag in an upright position.

2. Background Discussion

Plastic trash bags are widely used to hold various types of trash, and particularly are a convenient way of collecting trash such as leaves, tree cuttings, grass clippings, etc. occurring in maintaining a lawn. A problem with such trash bags is that it is difficult and inconvenient to hold the bag open with one hand while attempting to stuff trash into the bag with the other. The present invention alleviates this problem, providing an inexpensive, lightweight, reusable, device for holding a plastic trash bag in an open and upright condition to facilitate filling the bag.

SUMMARY OF THE INVENTION

There are several features of this invention which contribute to its convenience, no single one of which is solely responsible for this desirable attribute. Without limiting the scope of this invention as expressed by the claims, its more prominent features will now be discussed briefly. After considering this discussion, and particularly after reading the section of this application entitled DESCRIPTION OF THE PREFERRED EMBODIMENT, one will understand how the features of this invention provide a convenient device for facilitating filling a trash bag.

One feature of this invention is employing a tubular member as a liner for the trash bag. This member has opposed open ends and a diameter slightly less than the diameter of the open bag and a length slightly longer than the length of the open bag. In accordance with the method of this invention, this liner is first inserted into the open end of the bag, stretching the bag to its fully open position, enabling the user to stand the bag on its closed end with the bag upright and the open end maintained in the open position by the liner. The user then simply stuffs the trash into the inside of the liner. When the bag is full, the user removes the liner, and ties the bag.

Another feature of this invention is to employ a tubular liner member which has a configuration corresponding to a hollow, truncated, conical structure. The end of this liner member first be inserted into the bottom of the bag would have the widest diameter, which is still slightly less than the diameter of the open bag. The top open end of this liner member will have a diameter less than the base. Adjacent this open top end are a pair of opposed openings which allow the user to grip the liner member with one hand being inserted into each opening. the conical configuration provides the advantage that several of these liner members may be stacked together by inserting the smaller diameter end into the large diameter end of another conical liner member. This enables large numbers to be stacked up without taking up a great deal of space.

The third feature of this invention is the use of a removable bottom cover which includes locking means for holding the cover secured to the liner member. Upon unlocking the locking means, the cover may be removed. With the cover removed the liner member is inserted into the open bag and then the cover is placed over the bag and locked in position with the bag sandwiched between the liner member and cover. The sidewalls of the bag are pulled up towards the open top of the conical structure and then this structure is filled with trash by placing the trash in the open top end.

The use of a cover member to cover the bottom of the device enables the bag to be moved from place to place without the danger of the weight of the trash in the bag splitting open the bottom and spilling on the ground. Thus the bottom cover provides the necessary support so that the device can be jostled about roughly without the fear of damaging the trash bag.

The fifth feature of this invention is the use of a lid which may be placed on the open top end to cover this end. This enables one to partially fill the bag, cover the liner member, and then at another time remove the lid and continue filling the bag. The contents of the bag are maintained safe within the liner until the bag is entirely filled, whereupon the liner is removed and the trash bag discarded. The liner is now able to be used over again.

BRIEF DESCRIPTION OF THE DRAWING

The preferred embodiment of this invention illustrating all of its features will now be discussed in detail. In connection with the drawing, wherein like numerals indicate like parts, and in which:

FIG. 1 is a perspective view of the bag support device of this invention in an assembled condition, holding a trash bag in an open and upright position.

FIG. 2 is an exploded perspective view of the bag support device of this invention.

FIG. 4 is a fragmentary cross-sectional view showing the lid covering the top, open end of the bag support of this invention.

FIG. 5 is a fragmentary cross-sectional view showing a bag with the liner member inserted therein and the cover locked in position.

DESCRIPTION OF THE PREFERRED EMBODIMENT

Figure 3:
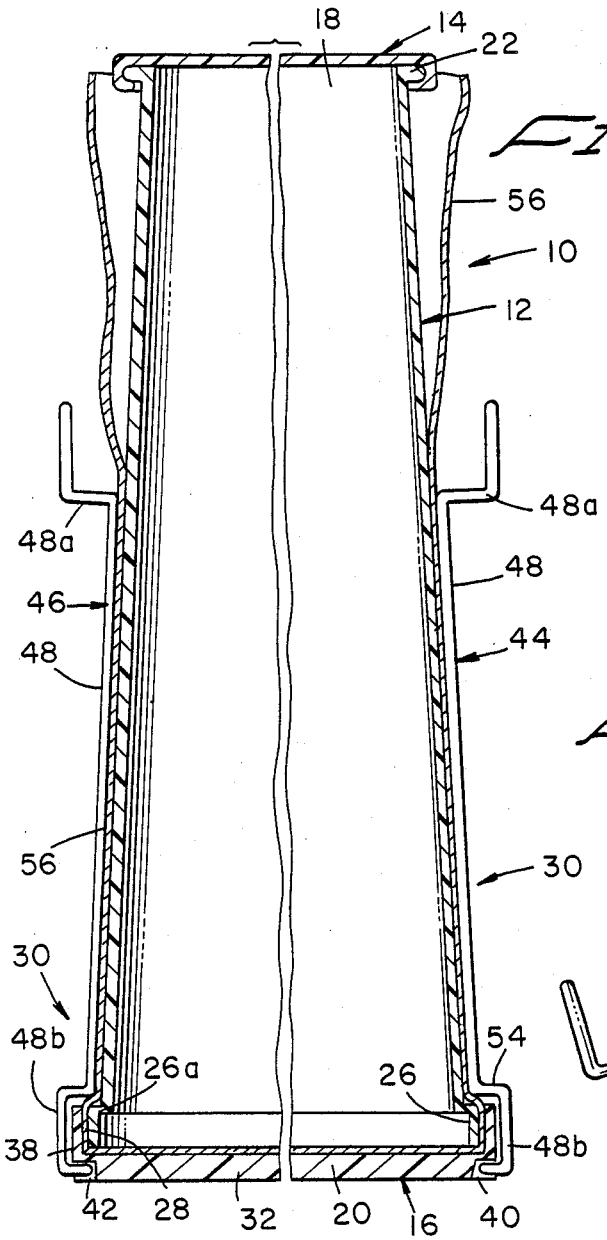
FIG. 3 is a cross-sectional view taken along line 3—3 of FIG. 1.

As illustrated in FIG. 1, the bag support device 10 of this invention has three major components: the tubular liner member 12, the lid 14 covering the top of the member, and a removable bottom cover 16 covering the bottom of the member.

The liner member 12 is preferably a hollow, truncated, conical structure made of a plastic material and having opposed open top and bottom ends 18 and 20. The top end 18 includes a circumferential rim 22 and adjacent this rim and opposed to each other are two oval openings 24 which permit the user to grasp the liner member with both hands by placing one hand in each of the oval openings. The bottom end 20 also includes a circumferential rim 26 which has an offset step **26*a* therein approximately one half inch deep. This rim 26, as best illustrated in FIG. 5**, fits snugly into a recess 28 in the bottom cover 16. This rim 26 surrounds the entire open bottom end 20 and, as will be explained in greater detail below, the offset step 26*a* interacts with locking means 30 for removably securing the bottom cover 16 in position.

Figure 6:
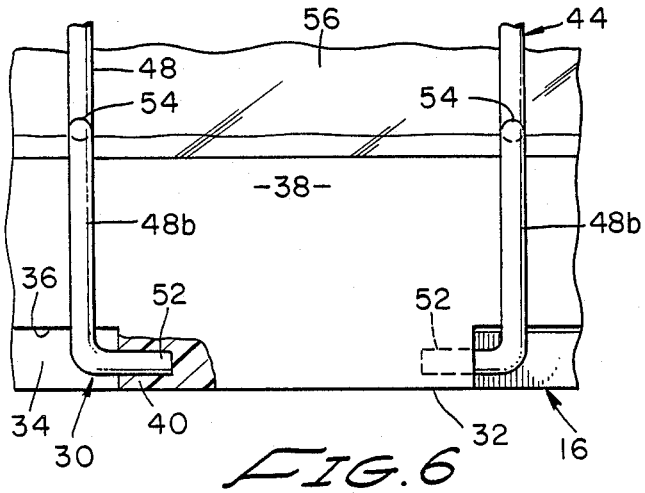
FIG. 6 is a fragmentary end view showing the handle for the cover in the locked position.
Figure 7:
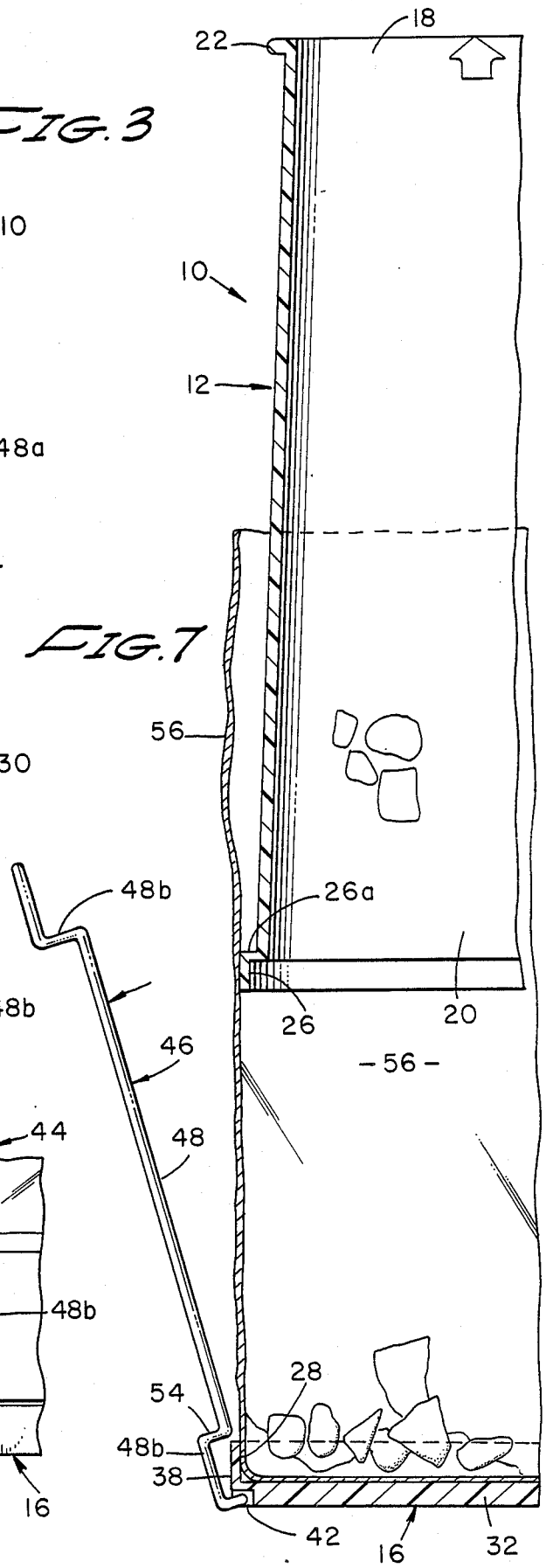
FIG. 7 is cross-sectional view showing the handles in the unlocked position and the liner member being withdrawn from the bag.

As best shown in FIGS. 2, 5 and 6, the bottom cover 16 comprises a generally flat circular base 32 on which the device 10 rests when the cover is assembled with the liner member 12. A upwardly projecting wall 34 extends from the base 32 and joins a outwardly projecting wall 36 that supports a circumferential rim 38 which defines the perimeter of the bottom cover 16. This rim 38 has a diameter slightly larger than the diameter of the bottom rim 26 of the liner member 12 so that, when the liner member is inserted into the recess 28 defined by the rim 38, the rim 26 of the bottom cover nests in the recess with the step 26*a* being adjacent the top edge 38*a* of the rim 38. A pair of opposed bosses 40 and 42 carry the locking means 30 which includes a pair of opposed metal handles 44 and 46, each handle being hingedly mounted to one of the bosses. These handles 44 and 46 each include a wire type structure 48 including a cross base 50. The upper end of the wire structures have offset sections 48*a* which permits the user to easily grasp the handles and pull them outwardly, when the cover is to be removed, or move it inwardly toward the liner member 12 when the cover is to be locked into position. The lower ends of the handles include a gripping section 48*b* which has two curved wire pieces which have free ends 52 (FIG. 6) inserted into openings in opposed sides of the bosses 40 and 42 and flat wire pieces 54 which rest on and push against the assembled rims 26 and 38 when the liner member 12 is seated into the bottom cover 16. By moving the handles 44 and 46 downwardly, the locking means 30 is unlocked. By moving the handles 44 and 46 upwardly, the gripping sections 48*b* grasp both rims 26 and 38 to hold the liner member 12 to the bottom cover 16.

As best shown in FIG. 4, the rim 22 at the open top end 18 of the liner member 12 surrounds the open top end and interacts with the lip 14*a* of the lid 14 that fits snugly over the open top end. This lid 14 simply snaps on the open end 18 with the lip 14*a* engaging the top rim 22, expanding outwardly and gripping this rim. The lid 14 is easily removed by simply grasping it and pulling it from the open top end 18.

The device of this invention is simple to use. First the handles 44 and 46 are moved away from the liner member 12 unlocking the bottom cover 16 and removing the lid 14. The liner member is then inserted into the open end of a trash bag 56, pushing the side walls of the bag away from each other and opening the open end of the bag fully. The large diameter bottom end of the liner member 12 is seated in the bottom of the bag. With the liner member 12 positioned inside the bag, the bottom cover 16 is placed over the bottom end of the bag and liner 12 with the side wall of the bag being between the rim 26 surrounding the bottom end and the rim 38 of the cover. The side walls of the bag are pulled upwardly over the sidewall of the liner member 12 and then the handles 44 and 46 are moved upwardly towards the liner member 12, bringing the gripping sections 48*b* into overlapping and locking position, grasping both of the assembled rims 26 and 38.

The bag 56 is now fully opened with the liner member 12 in position and the cover 16 supporting the bottom of the bag so that any heavy articles will not rip the bottom of the bag open. The liner member 12 with the bag in the open position can now be carried about conveniently. If the bag 56 is only partially filled with trash, the lid 14 is placed over the top open end 18 until such time as the trash bag is completely filled, whereupon the liner member 12 is pulled from the bag. Upon pulling the liner member from the open bag, the bag will then be closed and disposed of and the device ready to be used again.

SCOPE OF THE INVENTION

The above description presents the best mode contemplated of carrying out the present invention as depicted by the embodiment disclosed. The combination of features illustrated by this embodiment provide the convenience of this invention. This invention is, however, susceptible to modifications and alternate constructions from the embodiment shown in the drawing and described above. Consequently, it is not the intention to limit it to the particular embodiment disclosed. On the contrary, the intention is to cover all modifications and alternate constructions falling within the scope of the invention as generally expressed by the following claims.

I claim:

1. A device for holding a plastic trash bag in an open, upright position comprising a hollow, truncated, conical liner member having a length slightly longer than the length of the bag and open top and bottom ends, with the bottom end being wider than the top end and having a diameter slightly less than the diameter of the open bag, said bottom end having thereat a circumferential rim, a cover for the bottom end which is removably attached to the bottom end and which has a circumferential rim that receives the circumferential rim of the liner member when said liner member is nested in said cover, each of said rims having a top edge and said top edges being aligned when the liner member is nested in the cover, said cover including opposed handle elements hingedly mounted to the cover and movable between a locked position and an unlocked position, each of said handles including a gripping section which bears against and engages the aligned rims when the handles are in the locking position and the liner member is nested in the cover, and handle means for the liner member adjacent the open top end that enable the user to grip the device with both hands and lift said device.

2. The device of claim 1 including a removable lid for the open top.

3. The device of claim 2, including a circumferential rim surrounding the open top, with said lid including a lip that engages and snaps onto said rim when placed on the open top.

* * * * *